US005146721A

United States Patent [19]

Candiracci

[11] Patent Number: 5,146,721

[45] Date of Patent: Sep. 15, 1992

[54] WALL PANEL WITH THERMOACOUSTIC INSULATION CHARACTERISTICS

[75] Inventor: Angelo Candiracci, Fano, Italy

[73] Assignee: Monolite S.r.l., Fano, Italy

[21] Appl. No.: 723,888

[22] Filed: Jul. 1, 1991

[51] Int. Cl.[5] ..... E04B 1/74; E04B 2/02; E04C 1/40

[52] U.S. Cl. ..... 52/144; 52/309.11; 52/309.12; 52/309.14; 52/309.17; 52/453; 52/454; 181/284; 181/290

[58] Field of Search ..... 52/405, 452, 453, 454, 52/309.12, 309.8, 309.9, 309.11, 309.14, 309.17, 144, 145; 181/284, 290

[56] References Cited

U.S. PATENT DOCUMENTS

| | | | |
|---|---|---|---|
| 782,810 | 2/1905 | Murphy | 52/454 |
| 1,553,412 | 9/1925 | Turk | 52/453 |
| 3,000,144 | 9/1961 | Kitson | 52/309.11 |
| 4,157,638 | 6/1979 | Della-Donna | 52/405 X |
| 4,241,555 | 12/1980 | Dickens et al. | 52/454 |
| 4,505,019 | 3/1985 | Deinzer | 52/309.12 X |
| 4,558,550 | 12/1985 | Marchais et al. | 52/309.8 X |
| 4,611,450 | 9/1986 | Chen | 52/309.12 X |
| 4,712,349 | 12/1987 | Riley et al. | 52/309.12 X |
| 4,811,770 | 3/1989 | Rapp | 52/453 X |

*Primary Examiner*—David A. Scherbel
*Assistant Examiner*—Robert Canfield
*Attorney, Agent, or Firm*—Guido Modiano; Albert Josif

[57] ABSTRACT

The panel with thermoacoustic insulation characteristics comprises an insulating layer made of foamed plastic material which has a succession of corrugated portions which are joined by reduced thickness portions. Metallic nets are associated with the opposite faces of the corrugated portions of the insulating layer and are mutually connected by transverse elements which pass through the insulating layer.

7 Claims, 1 Drawing Sheet

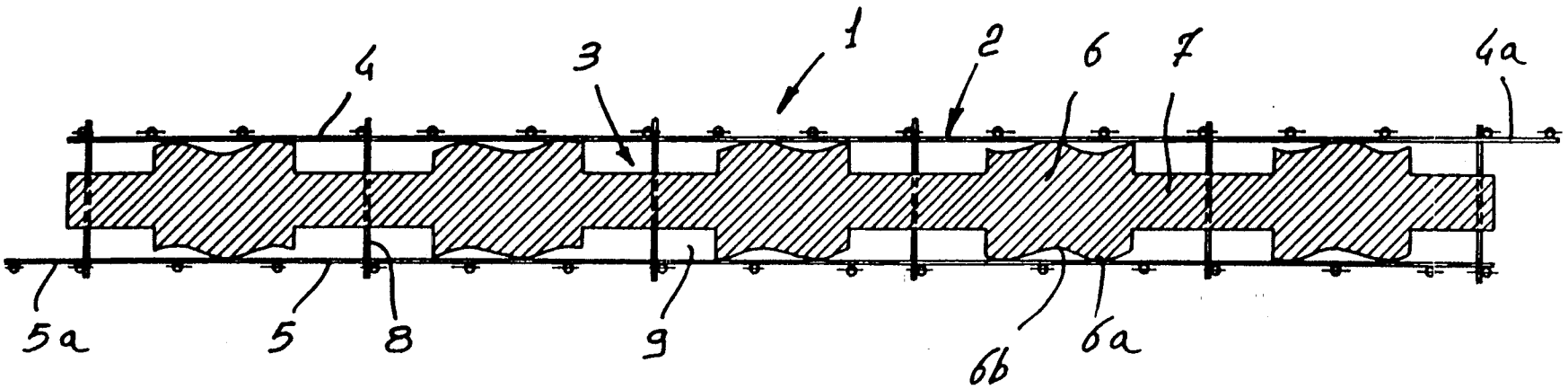
4a
7
6
2
1
3
4
6a
6b
9
8
5
5a

WALL PANEL WITH THERMOACOUSTIC INSULATION CHARACTERISTICS

BACKGROUND OF THE INVENTION

The present invention relates to a wall panel with thermoacoustic insulation characteristics.

The need to build partitions and load-bearing walls which can ensure high thermal and acoustic insulation is known in the field of building. The use of prefabricated panels in association with conventional building methods has been proposed for this purpose. However, the panels which are currently used have limited strength characteristics and are generally complicated to install.

Said panels are furthermore sometimes used to produce formwork suitable for the building of load-bearing walls. Said formwork is constituted by a pair of panels which are arranged side by side and are associated by means of appropriate spacer elements; an interspace suitable for containing a concrete casting is defined between the panels. This however entails greater structural complexity and poses problems of bulk both for transportation and for storage.

SUMMARY OF THE INVENTION

The technical aim of the present invention is to provide a panel which allows the on-site building, in a rapid and easy manner, of load-bearing walls with characteristics of considerable strength and of high thermoacoustic insulation.

Within the scope of this aim, an object of the present invention is to provide a panel of the above mentioned type which is simple in concept, has a small weight and bulk, is easy to install, is versatile in use and has a relatively low cost.

This aim and this object are both achieved, according to the invention, by the present wall panel with characteristics of thermoacoustic insulation, which is characterized in that it comprises an insulating layer made of foamed plastic material which has a succession of portions which have parallel corrugations and are joined by portions with a reduced thickness, and a grid formed by a pair of metallic nets which are associated with the opposite faces of said corrugated portions of the insulating layer and are mutually connected by transverse elements which pass through said insulating layer.

BRIEF DESCRIPTION OF THE DRAWINGS

The details of the invention will become apparent from the detailed description of a preferred embodiment of the wall panel with characteristics of thermoacoustic insulation, illustrated only by way of non-limitative example in the accompanying drawing, wherein:

the only figure is a horizontal sectional view of a panel according to the present invention.

DESCRIPTION OF THE PREFERRED EMBODIMENTS

With particular reference to said figure, the reference numeral 1 generally indicates the wall panel with thermoacoustic insulation characteristics.

The panel 1 is constituted by a metallic grid 2 which has an insulating layer 3 made of foamed material such as polystyrene. More particularly, the grid 2 comprises a pair of electrically welded metallic nets 4 and 5 with a rectangular mesh, between which the insulating layer 3 is interposed.

The metallic nets 4, 5 are preferably made of hot-galvanized, cold-redrawn high strength steel wires with a low carbon content; the vertical wires are electrically welded so as to form a rectangular mesh of an asymmetric type.

The insulating layer 3 is preferably made of high-density polystyrene of the virgin self-extinguishing type.

The insulating layer 3 has a succession of portions 6 which have parallel corrugations and are joined by reduced-thickness portions 7. The corrugated portions 6 define an alternated succession of crests **6*a* and troughs 6*b*** which extend longitudinally to said portions and are intended to be vertical in the installation position.

The metallic nets 4 and 5 are associated with the insulating layer 3, tangentially in contact with the crests **6*a* of the opposite faces of the corrugated portions 6. In particular, the troughs 6*b*** of each face are arranged in a median position with respect to the correspondingly parallel wires of the metallic net associated with said face.

Conveniently, the nets 4 and 5 have, along the opposite sides intended to be vertical, respective laterally protruding wings **4*a* and 5*a* which protrude with respect to the layer 3**. Said wings are suitable for overlapping, upon installation, on the adjacent panels, so as to have practically no discontinuity in the product thus obtained.

The metallic nets 4 and 5 are mutually connected by means of iron elements 8 which are driven transversely through the reduced-thickness portions 7 of the insulating layer 3. The iron elements 8 are equally made of galvanized high strength steel wires, preferably chisel-cut so as to perforate the insulating layer 3 without breaking it; the iron elements 8 are welded to the nets 4, 5 so as to constitute a rigid coupling. The nets are mutually connected asymmetrically, so as to offset or stagger the two sides.

The described panel allows to easily build walls which have high thermoacoustic insulation characteristics, which are easy to install and which can be adapted to the different construction requirements. The panels have loose reinforcements.

In particular, it is possible to use the panel 1 as a base element of a "sandwich" obtained by applying on the opposite faces a layer of structural concrete-type roughcast with synthetic fibers, provided with appropriate strength characteristics. The roughcast can be applied by spraying, by means of an appropriate nozzle. The metallic nets 4 and 5, by virtue of the shaping of the insulating layer 3, are incorporated in the layer of roughcast.

The presence of the metallic overlap provided by the wings **4*a*, 5*a*** in the coupling plane of the panels determines a continuity which hinders the forming of fissures at this critical region.

The reduced-thickness portions 7 furthermore define, between the adjacent corrugated portions 6, respective compartments 9 suitable for being filled with a concrete casting for the execution of corresponding pillars. The concrete casting can be integrated, if necessary, by bar reinforcements.

The panels 1 in summary allow to provide vertical elements with structural load-bearing characteristics which are suitable for the building of walls of buildings. The "sandwich" can furthermore be used as a curtain wall or as internal partitioning element, to complete a building built with conventional methods.

The vertical elements have high characteristics of rigidity, monolithicity and light weight and can be adapted to any constructive form. They furthermore have a very small bulk, since they are constituted by a single panel without interspaces.

The fact should furthermore be stressed that the panels can be executed horizontally with the same machine.

In the practical execution of the invention, the materials employed, as well as the shape and dimensions, can be any according to the requirements.

I claim:

1. A wall panel with thermoacoustic insulation characteristics comprising;

a pair of metallic nets made of wires;

an insulating layer made of foamed plastic material and being interposed between said metallic nets;

opposite faces defined by said insulating layer;

elements perforating said insulating layer and being connected to each of said pair of said metallic nets, reduced thickness portions defined by said insulating layer;

corrugated portions defined by said insulating layer and being interconnected by reduced thickness portions, and;

an alternate succession of troughs and crests defined by said corrugated portions at said opposite faces of said insulating layer;

wherein said wires of said pair of metallic nets include wires arranged parallel to and overlying said troughs, said troughs being arranged in a median position with respect to said wires arranged parallel to and overlying said troughs.

2. Wall panel according to claim 1, wherein each of said pair of metallic nets comprises an electrically welded net having a rectangular mesh, said electrically welded net being made of cold-redrawn high strength steel wires, said steel wires having a low carbon content.

3. Wall panel according to claim 1, wherein said insulating panel is made of self-extinguishing high-density polystyrene.

4. Wall panel according to claim 1, wherein said elements comprise galvanized high-strength steel wires, said steel wires being chisel-cut and welded to each of said pair of said metallic nets.

5. Wall panel according to claim 1, wherein said crests and troughs extend longitudinally along said corrugated portions.

6. Wall panel according to claim 1, wherein said panel further comprises at least two laterally protruding wings, one of said laterally protruding wings being defined by one of said pair of metallic nets at one of said opposite faces of said insulating panel, the other of said wings being defined by the other of said metallic nets at the other of said opposite faces of said insulating panel.

7. A wall panel with thermoacoustic insulation characteristics comprising;

a pair of metallic nets made of wires;

an insulating layer made of foamed plastic material and being interposed between said metallic nets;

opposite faces defined by said insulating layer;

elements perforating said insulating layer and being connected to each of said pair of said metallic nets, reduced thickness portions defined by said insulating layer;

corrugated portions defined by said insulating layer and being interconnected by reduced thickness portions, and;

an alternate succession of troughs and crests defined by said corrugated portions at said opposite faces of said insulating layer, said crests and troughs extending longitudinally along said corrugated portions;

wherein said wires of said pair of metallic nets include wires arranged parallel to and overlying said troughs, said troughs being arranged in a median position with respect to said wires arranged parallel to and overlying said troughs, and wherein each of said pair of metallic nets comprises an electrically welded net having a rectangular mesh, said electrically welded net being made of cold-redrawn high strength steel wires, said steel wires having a low carbon content, said insulating panel is made of self-extinguishing high-density polystyrene, said elements comprising galvanized high-strength steel wires, said steel wires being chisel-cut and welded to each of said pair of said metallic nets, said panel further comprises at least two laterally protruding wings, one of said laterally protruding wings being defined by one of said pair of metallic nets at one of said opposite faces of said insulating panel, the other of said wings being defined by the other of said metallic nets at the other of said opposite faces of said insulating panel.

* * * * *